US011142859B2

(12) United States Patent
Lv et al.

(10) Patent No.: US 11,142,859 B2
(45) Date of Patent: Oct. 12, 2021

(54) DAMPING DEVICE FOR A WASHING MACHINE, AND WASHING MACHINE

(71) Applicants: CHONGQING HAIER DRUM WASHING MACHINE CO., LTD., Chongqing (CN); HAIER SMART HOME CO., LTD., Shandong (CN)

(72) Inventors: Peishi Lv, Shandong (CN); Lin Yang, Shandong (CN); Gangjin Zhang, Shandong (CN); Yun Tian, Shandong (CN); Chunxia Zhou, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 139 days.

(21) Appl. No.: 16/348,307

(22) PCT Filed: Nov. 10, 2017

(86) PCT No.: PCT/CN2017/110401
§ 371 (c)(1),
(2) Date: May 8, 2019

(87) PCT Pub. No.: WO2018/086578
PCT Pub. Date: May 17, 2018

(65) Prior Publication Data

US 2019/0264366 A1 Aug. 29, 2019

(30) Foreign Application Priority Data

Nov. 10, 2016 (CN) ..... 201610997614.0

(51) Int. Cl.
*D06F 37/20* (2006.01)
*D06F 37/24* (2006.01)
(Continued)

(52) U.S. Cl.
CPC ..... *D06F 37/20* (2013.01); *D06F 37/24* (2013.01); *D06F 37/268* (2013.01); *D06F 23/04* (2013.01)

(58) Field of Classification Search
CPC ..... D06F 37/20; D06F 37/24; D06F 23/04; D06F 37/268
See application file for complete search history.

(56) References Cited

U.S. PATENT DOCUMENTS 6,397,643 B1 6/2002 Chang et al.
2011/0308281 A1* 12/2011 Yu ..... D06F 37/22 68/212

(Continued)

FOREIGN PATENT DOCUMENTS

CN 1275648 A 12/2000
CN 103215785 A 7/2013

(Continued)

OTHER PUBLICATIONS

International Search Report (PCT/ISA/210) and Written Opinion (PCT/ISA/237) dated Feb. 22, 2018, by the Chinese Patent Office as the International Searching Authority for International Application No. PCT/CN2017/110401.

*Primary Examiner* — Joseph L. Perrin
(74) *Attorney, Agent, or Firm* — Buchanan Ingersoll & Rooney PC

(57) ABSTRACT

A damping device for a washing machine and a washing machine are provided. The damping device for a washing machine comprises a damping suspension rod, an upper bracket, a damping spring, a sliding damping support seat, and a sliding damping piece. An upper end of the damping suspension rod is installed on a cabinet of the washing machine, the upper bracket is installed on an outer tub of the washing machine. The damping suspension rod, passes through the upper bracket, the sliding damping piece, the (Continued)

sliding damping support seat and the damping spring in sequence from top to bottom. The outer tub of the washing machine shakes or swings to put an eccentric pressure on the upper bracket, then the damping spring is compressed, and the sliding damping piece is tightened to generate a sliding damping acting on the damping suspension rod.

20 Claims, 5 Drawing Sheets

(51) Int. Cl.
*D06F 37/26* (2006.01)
*D06F 23/04* (2006.01)

(56) References Cited

U.S. PATENT DOCUMENTS

2014/0367536 A1* 12/2014 Wong ..... D06F 37/262 248/176.1
2016/0010259 A1* 1/2016 Jeon ..... D06F 37/24 68/132
2016/0010260 A1* 1/2016 Kim ..... F16F 7/08 68/131
2016/0010261 A1* 1/2016 Kim ..... D06F 37/24 68/23.2
2016/0024705 A1* 1/2016 Hernden ..... F16F 7/08 267/140.13
2016/0326679 A1* 11/2016 Jung ..... D06F 37/203
2017/0016164 A1* 1/2017 Kim ..... D06F 37/24

FOREIGN PATENT DOCUMENTS

CN 105839348 A 8/2016
CN 106930046 A 7/2017
CN 106930047 A 7/2017
JP S59-013282 U 1/1984
JP H08-010489 A 1/1996
JP 2000-107488 A 4/2000
KR 19990016950 A 3/1999
KR 19990040957 A 6/1999
KR 20090012698 U 12/2009

* cited by examiner

DAMPING DEVICE FOR A WASHING MACHINE, AND WASHING MACHINE

TECHNICAL FIELD

The present disclosure relates to the technical field of damping of a washing machine, in particular to a damping device for a washing machine and a washing machine.

BACKGROUND

When the automatic washing machine starts dehydration process and operates dehydration process, an outer tub will shake or swing along with the motor starting, resulting in greater vibration and noise. Therefore, in order to weaken vibration and noise of the washing machine during dehydration, the existing automatic washing machines are generally provided with a damping device. One end of the damping device is hoisted on a cabinet of the washing machine, while the other end is suspended on a hanging seat of an outer tub of the washing machine. The damping device is internally provided with a damping spring, and when the outer tub shakes or swings, the damping device relieves the eccentricity of the outer tub through the buffering effect of the damping spring to achieve the purpose of damping. However, along with the development of the washing machine, when the eccentricity of the washing machine is large, if only the damping effect of a damping spring is relied on, shaking and swinging of the outer tub cannot be effectively prevented.

Some of the damping devices of the existing washing machine are only provided with a damping spring, and are mostly applied to small-capacity washing machines. For some damping devices, a sliding damping structure is additionally added on the basis of the damping spring. However, the provided sliding damping force is too small, thereby being incapable of playing an effect of damping and noise reduction. Still for some damping devices, a friction rubber piece is added between the sliding damping support seat and the upper bracket, however, such a structure is high in cost and poor in reliability, and after long-term abrasion, the friction damping force will disappear gradually.

In view of this, the present disclosure is hereby proposed.

SUMMARY

In order to solve the above problem, the first inventive objective of the present disclosure is to provide a damping device for a washing machine, in particular, the following technical solution is adopted:

A damping device for a washing machine comprises a damping suspension rod, an upper bracket, a damping spring, a sliding damping support seat and a sliding damping piece. An upper end of the damping suspension rod is installed on a cabinet of the washing machine, the upper bracket is installed on an outer tub of the washing machine, and the damping suspension rod passes through the upper bracket, the sliding damping piece, the sliding damping support seat and the damping spring in sequence from top to bottom; and the upper bracket is exerted an eccentric pressure by shaking or swinging of the outer tub of the washing machine, the damping spring is compressed, and the sliding damping piece is tightened to generate a sliding damping acting on the damping suspension rod. Along with the increase of the eccentric force, the sliding damping support seat and the sliding damping piece are simultaneously tightened to increase the sliding damping acting on the damping suspension rod; and the upper bracket is released by shaking or swinging of the outer tub of a washing machine, the damping spring is elongated, the sliding damping support seat and the sliding damping piece are gradually loosened, and the sliding damping acting on the damping suspension rod is gradually reduced.

As a preferred implementation of the present disclosure, an end, close to the sliding damping piece, of the sliding damping support seat is provided with an accommodation chamber, and a first end of the sliding damping piece is against the upper bracket, a second end of the sliding damping piece extends into the accommodation chamber of the sliding damping support seat.

As a preferred implementation of the present disclosure, the sliding damping piece includes an annular damping fin and multiple damping blocks arranged at one side of the annular damping fin and distributed along the inner ring of the annular damping fin, and a through hole located in a center to allow the damping suspension rod to pass through is formed by the damping blocks.

As a preferred implementation of the present disclosure, an upper wall surface of the annular damping fin of the sliding damping piece is contacted with the upper bracket, a lower wall surface of the annular damping fin of the sliding damping piece is contacted with an upper end face of the sliding damping support seat, and the damping block of the sliding damping piece extends into the accommodation chamber of the sliding damping support seat.

As a preferred implementation of the present disclosure, an annular convex rib is arranged on an upper wall surface of the annular damping fin of the sliding damping piece, and a lower wall of the upper bracket is provided with an annular groove matched with the annular convex rib.

As a preferred implementation of the present disclosure, the sliding damping support seat is provided with an inclined structure for transferring an eccentric force to generate a sliding damping acting on the damping suspension rod when the outer tub shakes or swings; and an accommodation chamber is formed at the inner of the inclined structure.

As a preferred implementation of the present disclosure, the sliding damping support seat comprises an annular body arranged at one end of the sliding damping support seat and elastomers respectively connected with the annular body, wherein the annular body and the sliding damping piece are against each other, the elastomers extend into the damping spring, and a through hole located in the center to allow the damping suspension rod to pass through is formed by the elastomers; and a first part of each of the elastomers connected with the annular body is obliquely disposed to form an inclined structure, or the inclined structure is an inclined rib connecting for connecting each of the elastomers and the annular body.

As a preferred implementation of the present disclosure, an outer wall of the sliding damping support seat is provided with an annular blocking rib, and an upper end of the damping spring is abutted against the annular blocking rib.

As a preferred implementation of the present disclosure, the sliding damping support seat is integrally formed from a plastic material, and the sliding damping piece is a rubber damping block.

A second inventive objective of the present disclosure is to provide a washing machine, specifically, the following technical solution is adopted:

A washing machine provided with a damping device for a washing machine mentioned in any of the above items is provided.

The damping device for a washing machine of the present disclosure comprises a sliding damping support seat and a sliding damping piece. The sliding damping support seat can be made of ordinary plastic material, therefore, the manufacturing cost is low. The sliding damping piece is made of rubber material and can gradually increase the sliding damping force when subjected to a large pressure. Along with the shaking or swinging of the outer tub, the upper bracket, the sliding support seat and the sliding damping piece will slide up and down along the damping suspension rod, and the damping spring will be compressed or released.

When the outer tub shakes or swings to put downwards an eccentric force on the upper bracket, the damping spring is compressed, and the sliding damping piece will be tightened under the extrusion of the sliding damping support seat. If the eccentric force is larger, the sliding damping support seat will be also tightened along with the increase of pressure, and will be in friction with the suspension rod to generate a sliding friction damping force. When the outer tub shakes or swings to release the pressure on the upper bracket, the damping spring is elongated, and the sliding damping piece and the sliding damping support seat will be loosened, then the friction with the damping suspension rod is gradually reduced, and the generated sliding friction damping force is reduced or completely released, then each part of the damping device for the washing machine is reset.

The damping device for a washing machine of the present disclosure comprises a sliding damping support seat and a sliding damping piece. When the dehydration process of the washing machine is started and operated, the friction between the sliding damping support seat and the damping suspension rod and the friction between the sliding damping piece and the damping suspension rod respectively provides a sliding damping force to the outer tub, thereby effectively reducing shaking and swinging of the outer tub, especially playing a better damping effect on large-capacity washing machines, and enabling the washing machine to keep quiet and stable dehydration starting and operation.

The washing machine provided with the damping device for the washing machine of the present disclosure can keep quiet and stable dehydration starting and operation.

Figure 1:
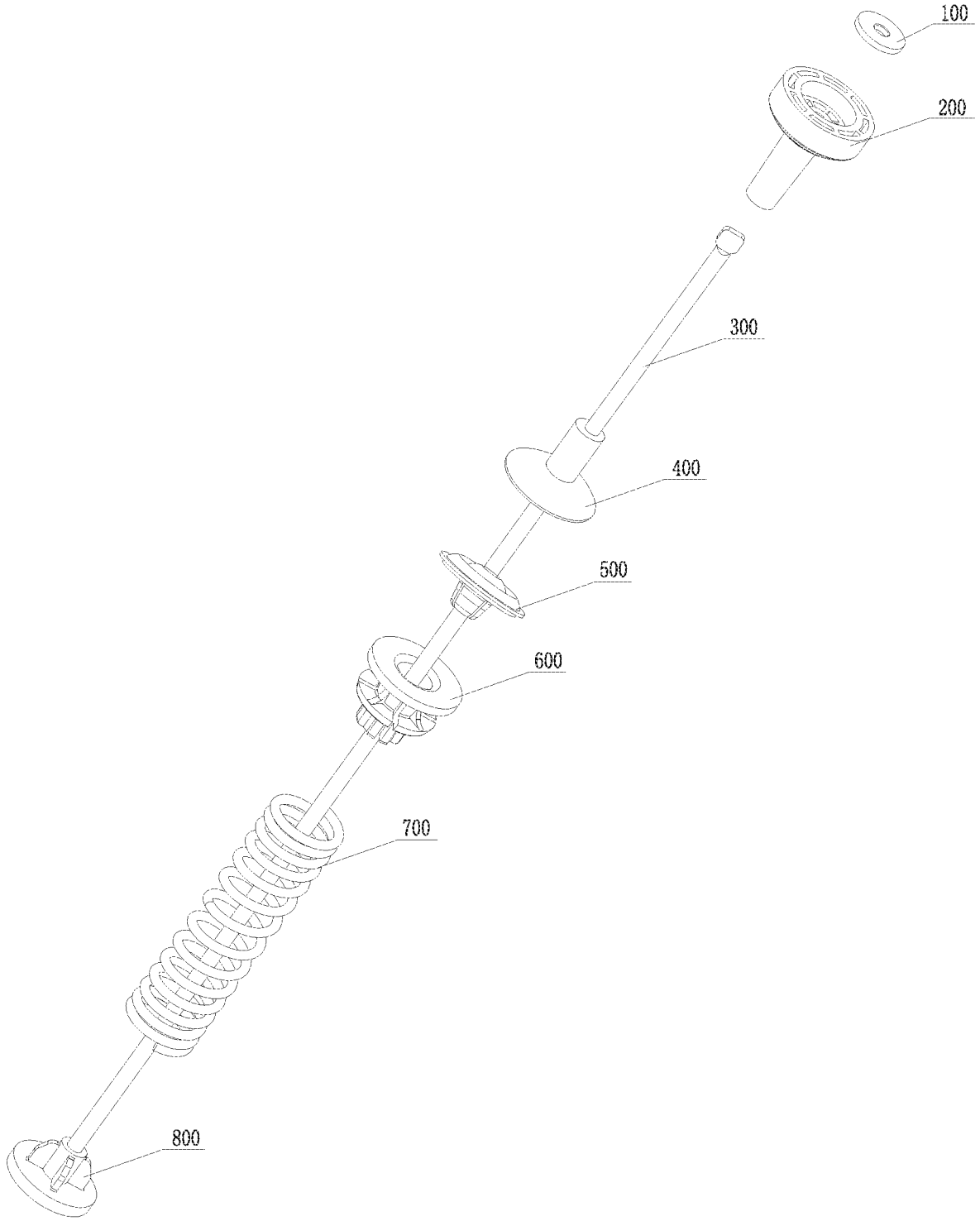
FIG. 1 is an exploded view of a damping device for a washing machine of the present disclosure.

Reference numerals in the figures: 100—gasket 200—suspension rod seat 300—damping suspension rod 400—upper bracket 500—sliding damping piece 501—annular damping fin 502—damping block 503—damping block clearance 504—sliding damping surface 600—sliding damping support seat 601—annular body 602—inclined structure 603—reinforcing rib 604—blocking rib 605—elastic clearance 606—elastomer 700—damping spring 800—lower bracket.

DETAILED DESCRIPTION OF THE EMBODIMENTS

Figure 2:
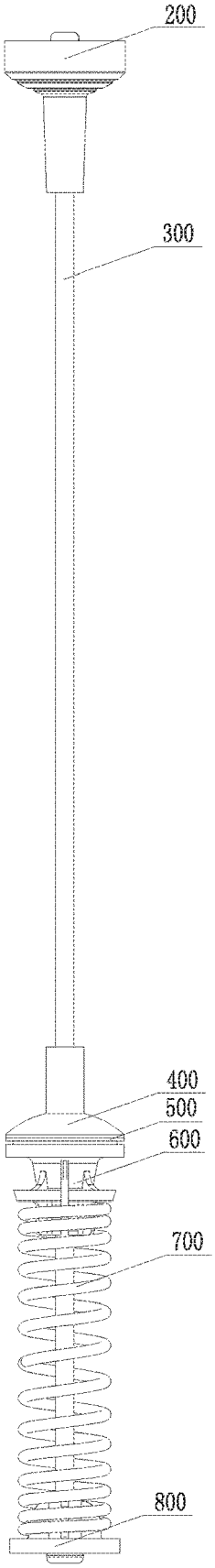
FIG. 2 is a front view of a damping device for a washing machine of the present disclosure.
Figure 3:
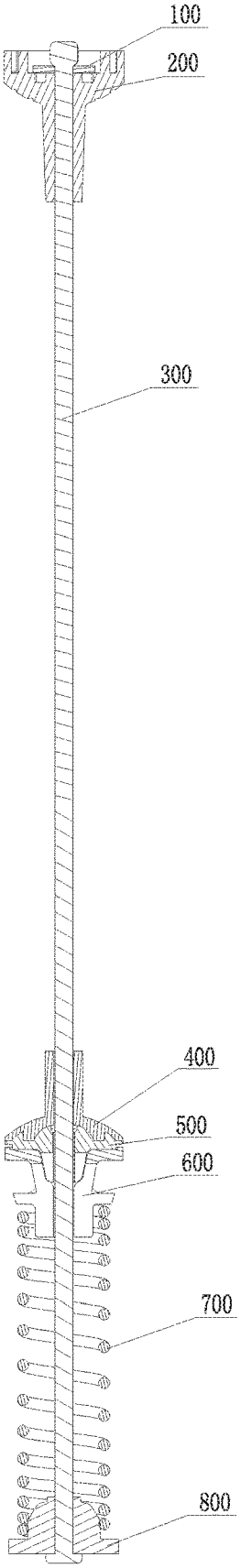
FIG. 3 is a sectional view of a damping device for a washing machine of the present disclosure.
Figure 4:
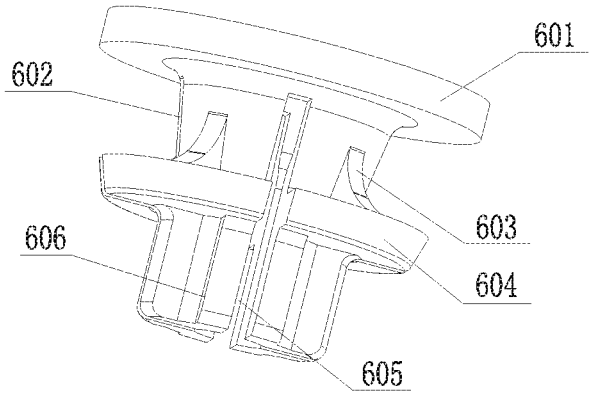
FIG. 4 is a first schematic diagram of a three-dimensional structure of a sliding damping support seat of the damping device for a washing machine in the present disclosure.
Figure 5:
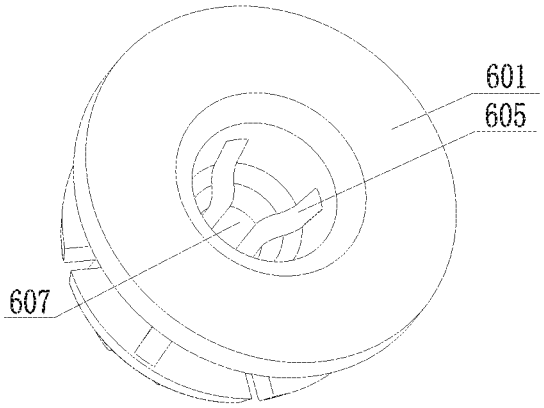
FIG. 5 is a second schematic diagram of a three-dimensional structure of a sliding damping support seat of the damping device for a washing machine in the present disclosure.
Figure 6:
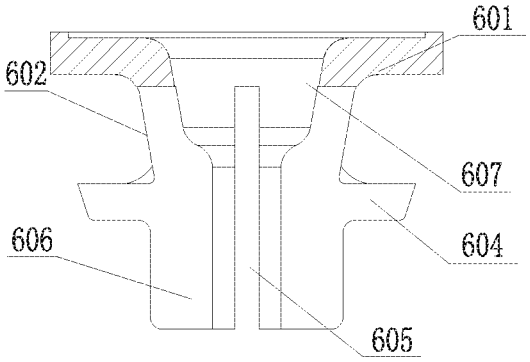
FIG. 6 is a sectional view of a sliding damping support seat of a damping device for a washing machine in the present disclosure.
Figure 7:
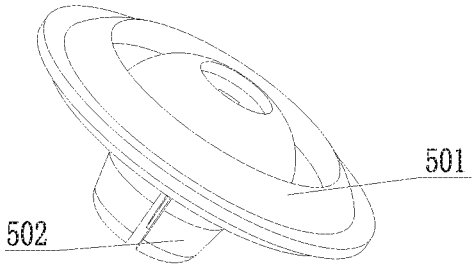
FIG. 7 is a schematic diagram of a three-dimensional structure of an upper part of a sliding damping piece of the damping device for a washing machine in the present disclosure.
Figure 8:
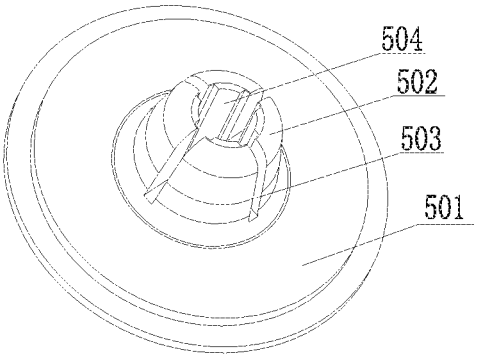
FIG. 8 is a schematic diagram of a three-dimensional structure of a backside of a sliding damping piece of the damping device for a washing machine in the present disclosure.

A detailed description will be given below on a damping device for a washing machine and a washing machine of the present disclosure in combination with accompanying drawings:

As shown in FIG. 1, FIG. 2 and FIG. 3, a damping device for a washing machine in the present embodiment comprises a damping suspension rod 300, an upper bracket 400, a damping spring 700, a sliding damping support seat 600 and a sliding damping piece 500. An upper end of the damping suspension rod 300 is installed on a cabinet of a washing machine, the upper bracket 400 is installed on an outer tub of the washing machine, and the damping suspension rod 300 passes through the upper bracket 400, the sliding damping piece 500, the sliding damping support seat 600 and the damping spring 700 in sequence from top to bottom.

The upper bracket is exerted an eccentric pressure by shaking or swinging of the outer tub of the washing machine, the damping spring 700 is compressed, and the sliding damping piece 500 is tightened to generate a sliding damping acting on the damping suspension rod 300. Along with the increase of the eccentric force, the sliding damping support seat 600 and the sliding damping piece 500 are simultaneously tightened to increase the sliding damping acting on the damping suspension rod 300. The upper bracket is released by shaking or swinging of the outer tub of a washing machine, the damping spring 700 is elongated, the sliding damping support seat 600 and the sliding damping piece 500 are gradually loosened, and the sliding damping acting on the damping suspension rod 300 is gradually reduced.

The damping device for a washing machine of the present embodiment includes a sliding damping support seat 600 and a sliding damping piece 500. The sliding damping support seat 600 can be made of ordinary plastic material, therefore, the manufacturing cost is low. The sliding damping piece 500 is made of rubber material and can gradually increase the sliding damping force when subjected to a large pressure. Along with the shaking or swinging of the outer tub, the upper bracket 400, the sliding support seat 600 and the sliding damping piece 500 will slide up and down along the damping suspension rod, and the damping spring 700 will be compressed or released.

As to the damping device for a washing machine of the present embodiment, when the dehydration process of the washing machine is started and operated, the friction between the sliding damping support seat 600 and the damping suspension rod 300 and the friction between the sliding damping piece 500 and the damping suspension rod 300 respectively provides a sliding damping force to the outer tub, thereby effectively reducing shaking and swinging of the outer tub, especially playing a better damping effect on large-capacity washing machines, and enabling the washing machine to keep quiet and stable dehydration starting and operation.

As to the damping device for a washing machine in the present embodiment, a sliding damping support seat 600 and a sliding damping piece 500 are simultaneously installed on the damping suspension rod 300. In order to realize that the sliding damping support seat 600 and the sliding damping piece 500 can both generate a favorable sliding damping, the sliding damping support seat 600 and the sliding damping piece 500 adopt the following installation:

an end, close to the sliding damping piece 500, of the sliding damping support seat 600 of the present embodiment is provided with an accommodation chamber, and a first end of the sliding damping piece 500 is against the upper bracket 400, while a second end of the sliding damping piece extends into the accommodation chamber of the sliding damping support seat 600.

The sliding damping piece 500 of the present embodiment is directly against the upper bracket 400, when the outer tub shakes or swings, an eccentric force directly acts on the upper bracket 400, then the upper bracket 400 directly acts on the sliding damping piece 500, and the sliding damping piece 500 is in extrusion friction with the damping suspension rod 300 to generate a sliding damping. When the outer tub is in general shaking or swinging, the sliding damping generated by the sliding damping piece 500 can satisfy the requirements of damping. When the outer tub shakes or swings with great amplitude, the eccentric force is larger, and one end of the sliding damping piece 500 extends into the accommodation chamber of the sliding damping support seat 600, therefore, the eccentric force can be further transferred to the sliding damping support seat 600, and the sliding damping support seat 600 can also be in extrusion friction with the damping suspension rod 300 to generate a sliding damping, so as to further enhance the effect of damping.

As a preferred implementation of the present embodiment, the sliding damping piece 500 comprises an annular damping fin 501 and multiple damping blocks 502 which are arranged at one side of the annular damping fin 501 and distributed along the inner ring of the annular damping fin, and a through hole which is located in the center to allow the damping suspension rod to pass through is formed by the damping blocks 502.

A damping block clearance 503 is formed between the adjacent damping blocks 502 of the present embodiment, such that when the outer tub does not shake or swing, the damping blocks 502 are loosened, the sliding damping between the damping blocks 502 and the damping suspension rod 300 is smaller. When the outer tub shakes or swings, the damping blocks 502 are tightened, then the sliding damping between the damping blocks 502 and the damping suspension rod 300 is increased.

Further, in the present embodiment, an upper wall surface of the annular damping fin 501 of the sliding damping piece 500 is contacted with the upper bracket 400, a lower wall surface of the annular damping fin 501 of the sliding damping piece 500 is contacted with an upper end face of the sliding damping support seat 600, and the damping block 502 of the sliding damping piece 500 extends into the accommodation chamber of the sliding damping support seat 600. Through such a setting mode, the eccentric force can be transferred from the upper bracket 400 to the sliding damping piece 500 and from the sliding damping piece 500 to the sliding damping support seat 600.

As a preferred implementation of the present embodiment, an annular convex rib is arranged on the upper wall surface of the annular damping fin 501 of the sliding damping piece 500, and a lower wall of the upper bracket 400 is provided with an annular groove which is in match with the annular convex rib. In this way, on the one hand, coordination between the sliding damping piece 500 and the upper bracket 400 can be increased, and on the other hand, the annular convex rib is inclined towards the center, thereby being capable of better transferring the eccentric force to the damping block 502.

As a preferred implementation of the present embodiment, the sliding damping support seat 600 is provided with an inclined structure 602 for transferring an eccentric force when an outer tub shakes or swings to generate a sliding damping acting on the damping suspension rod 300. And the accommodation chamber is formed in the inner of the inclined structure 602.

The sliding damping support seat 600 of the present embodiment is provided with an inclined structure 602 which can effectively transfer the force applied by the outer tub. Along with the shaking or swinging of the outer tub, the upper bracket 400, the sliding damping piece 500 and the sliding damping support seat 600 will slide up and down along the damping suspension rod 300, and the damping spring 700 will be compressed or released. Preferably, in order to realize that the inclined structure 602 can effectively transfer the eccentric force, generated by shaking or swinging of the outer tub, to a deformable part of the sliding damping support seat 600, and a sliding damping is provided to the damping suspension rod to realize a favorable damping effect, the inclined structure 602 of the present embodiment inclines towards close to the damping suspension rod 300 along a direction from top to bottom of the damping suspension rod 300, such that an eccentricity component during compression generates a component force along a horizontal direction to act on a deformable part of the sliding damping support seat 600, and the sliding damping support seat is tightened to generate a sliding damping force.

When the outer tub shakes or swings to put downwards an eccentric force on the upper bracket 400, the damping spring 700 is compressed, the sliding damping support seat 600 is tightened and is in friction with the damping suspension rod 300 to generate a damping force. When the outer tub shakes or swings to release the pressure on the upper bracket, the damping spring 700 is elongated, and the sliding damping support seat 600 is released, then the friction with the damping suspension rod 300 is gradually reduced, and the generated sliding friction damping force is reduced or completely released. Then each part of the damping device is reset.

Therefore, the damping device for a washing machine of the present embodiment is provided with a sliding damping support seat 600, when the dehydration process of the washing machine is started and operated, the friction between the sliding damping support seat 600 and the damping suspension rod 300 provides a sliding damping force to the outer tub, thereby effectively reducing shaking and swinging of the outer tub, playing a favorable damping effect, and enabling the washing machine to keep quiet and stable dehydration starting and operation.

Therefore, the damping device for a washing machine in the present embodiment is provided with a sliding damping support seat 600 which is designed separately, which can perform good sliding friction damping on the damping suspension rod 300 and improve the damping effect of the washing machine. The sliding damping support seat 600 of the present embodiment can be used separately to satisfy damping requirements of general washing machines, or can be matched with the sliding damping block to further enhance the effect of sliding damping, so as to acquire a better damping effect and accommodate to washing machines of a larger specification. In addition, the sliding damping support seat 600 of the present embodiment can be made of ordinary plastic material, therefore, the manufacturing cost is low and the service life is long.

In order to realize that the sliding damping support seat 600 of the present embodiment can change the magnitude of the sliding damping on the damping suspension rod 300 along with the shaking or swinging of the outer tub, specifically, the sliding damping support seat 600 of the present embodiment includes an annular body 601 arranged at one end of the sliding damping support seat and elastomers 606 which are respectively connected with the annular body 601. The annular body 601 and the sliding damping piece 500 are against each other, the elastomers 606 extend into the damping spring 700, and a through hole located in the center to allow the damping suspension rod 300 to pass through is formed by the elastomers 606.

The outer tub of the washing machine shakes or swings to put an eccentric pressure on the upper bracket 400, then the damping spring 700 is compressed, and the inclined structure 602 of the sliding damping support seat 600 transfers an eccentric force to each elastomer 606, and each elastomer 606 is tightened to increase the sliding damping on the damping suspension rod 300. The outer tub of the washing machine shakes or swings to release the upper bracket, the damping spring 700 is elongated, and each of the elastomers 606 is loosened to reduce or completely release the sliding damping on the damping suspension rod 300.

An elastic clearance 605 is formed between elastomers 606 of the present embodiment. When the outer tub does not shake or swing, an inner wall of the elastomer is in contact with the damping suspension rod 300, but no extrusion friction occurs or the extrusion friction force is not large. When the outer tub shakes or swings, the elastomer 606 is tightened under the effect of an eccentric force transferred by the inclined structure 602, and the inner wall of the elastomer 606 is in close contact with the damping suspension rod 300 and the extrusion friction generates a larger sliding friction damping to slow down shaking or swinging of the outer tub and realize the effect of damping.

Preferably, four elastomers 606 of the present embodiment are available. Four elastomers 606 form a circle and the elastic clearance 605 is formed between the adjacent elastomers 606.

Specifically, the elastomers 606 of the present embodiment are distributed at equal intervals along circumference of the annular body 601. A first part of each of the elastomers 606 connected with the annular body 601 is obliquely disposed to form an inclined structure 602, or the inclined structure 602 is an inclined rib for connecting each of the elastomer 606 and the annular body 601.

The inclined structure 602 of the present embodiment is inclined towards the center of the annular body 601, in this way, the whole sliding damping support seat 600 tends to be gradually reduced from the annular body 601 to the elastomer 606. The sliding damping support seat 600 of the present embodiment can be molded in one body, and can also be formed by connecting each part together.

As a preferred implementation of the present embodiment, the elastomer 606 includes an inclined section and a vertical section. One end of the inclined section is connected with the annular body, another end of the inclined section is arranged to be inclined towards an inner side of the annular body. The vertical section is connected with the inclined section and is arranged along vertical direction. An inner wall of the vertical section of the elastomer 606 protrudes inwardly and is in contact with the damping suspension rod to generate a sliding damping on the damping suspension rod. The elastomer 606 and the inclined structure 602 of the present embodiment are molded in one body, the inclined section of the elastomer 606 is the inclined structure 602, and the vertical section is the deformed part which is in contact with the damping suspension rod 300 to generate a sliding friction damping.

As a preferred implementation of the present embodiment, a first end of the inclined rib is connected with the annular body 601, a second end of the inclined rib is inclined toward inner of the annular body 601 and is connected with the elastomer 606, and the elastomer 606 is arranged in a vertical direction. An inner wall of each of the elastomers 606 protrudes inwardly and is in contact with the damping suspension rod 300 to generate a sliding damping on the damping suspension rod. The inclined rib of the present embodiment and the annular body 601 can be molded in one body, and the elastomer 606 is fixedly connected with the inclined rib, in this way, the elastomer 606 can be made of rubber material with a higher damping coefficient, and elastomers 606 of corresponding specifications can be selected according to requirements to satisfy requirements of sliding damping.

In the present embodiment, multiple inclined ribs are available, and the inclined ribs and the elastomers 606 are in a one-to-one corresponding relationship along a circumferential direction of the annular body 601.

Further, in the present embodiment, an outer wall of an intersection between the inclined section and the vertical section of each elastomer 606 is respectively provided with a blocking rib 604, the blocking ribs 604 form an annular blocking rib, and an upper end of the damping spring 700 is abutted against the annular blocking rib.

Or, an outer wall of an intersection between each inclined rib and each elastomer 606 is respectively provided with a blocking rib 604, blocking ribs 604 form an annular blocking rib, and the upper end of the damping spring 700 is abutted against the annular blocking rib.

The sliding damping support seat 600 of the present embodiment is arranged between the sliding damping piece 500 and the damping spring 700. The annular body 601 of the sliding damping support seat 600 is abutted against the sliding damping piece 500. When the sliding damping piece 500 bears an eccentric force from the outer tub, the eccentric force can directly act on the sliding damping support seat 600, and the sliding damping support seat 600 is also provided with the annular blocking rib which is against the damping spring 700. In this way, part of the eccentric force of the outer tub can directly act on the damping spring 700 through the sliding damping support seat 600, and the damping spring 700 is compressed to provide a damping elastic force. Another part of eccentric force acts on the elastomer 606 through an inclined structure, and the elastomer 606 is in friction with the damping suspension rod 300 to generate a sliding friction damping. Therefore, the sliding damping support seat 600 of the present embodiment has a favorable damping effect for shaking and swinging of the outer tub of a washing machine.

As a preferred implementation of the present disclosure, a reinforcing rib 603 is arranged between the blocking rib 604 and an outer wall of the inclined section of the elastomer 606. Or a reinforcing rib 603 is arranged between the blocking rib 604 and an outer wall of the inclined rib. The reinforcing rib 603 is set to enhance overall strength of the sliding damping support seat 600. Therefore, the sliding damping support seat 600 has better abrasion performance and longer service life.

The damping device for a washing machine in the present embodiment further includes a suspension rod seat 200 which is fixedly installed on an upper end of the damping suspension rod 300, and the suspension rod seat 200 is hoisted on an upper part of a cabinet of the washing machine. A gasket 100 is additionally added between the suspension rod seat 200 and the cabinet of the washing machine to enhance the damping effect.

The damping device for a washing machine of the present embodiment further includes a lower bracket 800 which is fixedly installed on a lower end of the damping suspension rod 300, and the lower end of the damping spring 700 ends at and is abutted against the lower bracket 800.

Meanwhile, the present embodiment provides a washing machine provided with the damping device for a washing machine as mentioned in any one of the above items. The washing machine provided with the above damping device for a washing machine in the present disclosure can keep quiet and stable dehydration starting and operation.

The above descriptions are merely preferred embodiments of the present disclosure, rather than a limitation to the present disclosure in any form. Although the present disclosure is disclosed above through the preferred embodiments, however, the present disclosure is not limited hereto. Those skilled in the art can make some changes or modify to equivalent embodiments with equivalent changes by utilizing the technical contents enlightened above under the premise of not departing from the scope of the technical solution of the present disclosure. As long as the contents do not depart from the technical solution of the present disclosure, any simple alterations, equivalent changes and modifications made to the above embodiments according to the technical essence of the present disclosure shall still fall within the scope of the solution of the present disclosure.

The invention claimed is:

1. A damping device for a washing machine, the damping device comprising:

a damping suspension rod;

an upper bracket;

a damping spring;

a sliding damping support seat; and a sliding damping piece, wherein an upper end of the damping suspension rod is configured to be installed on a cabinet of the washing machine, the upper bracket is configured to be installed on an outer tub of the washing machine, and the damping suspension rod passes through the upper bracket, the sliding damping piece, the sliding damping support seat and the damping spring in sequence from top to bottom; and the sliding damping piece includes an annular damping fin, multiple damping blocks arranged at one side of the annular damping fin and distributed along an inner ring of the annular damping fin, and a through hole located in a center of the annular damping fin to allow the damping suspension rod to pass through, the through hole being formed by the damping blocks, the damping spring is configured to contract, and the sliding damping piece is configured to tighten and generate a sliding damping acting on the damping suspension rod when the outer tub of the washing machine shakes or swings to apply an eccentric pressure to the upper bracket, the sliding damping support seat and the sliding damping piece are configured to simultaneously tighten to increase the sliding damping acting on the damping suspension rod when the eccentric force increases, and the damping spring is configured to extend, the sliding damping support seat and the sliding damping piece are configured to gradually loosen, gradually reducing the sliding damping acting on the damping suspension rod when the outer tub of the washing machine shakes or swings to release the upper bracket.

2. The damping device for a washing machine according to claim 1, wherein an end, proximate to the sliding damping piece, of the sliding damping support seat is provided with an accommodation chamber, and a first end of the sliding damping piece abuts the upper bracket, a second end of the sliding damping piece extends into the accommodation chamber of the sliding damping support seat.

3. The damping device for a washing machine according to claim 2, wherein the sliding damping support seat is provided with an inclined structure configured for transferring an eccentric force to generate a sliding damping acting on the damping suspension rod when the outer tub shakes or swings;

and an accommodation chamber is formed in an inner of the inclined structure.

4. The damping device for a washing machine according to claim 2, wherein an outer wall of the sliding damping support seat is provided with an annular blocking rib, and an upper end of the damping spring is abutted against the annular blocking rib.

5. The damping device for a washing machine according to claim 2, wherein the sliding damping support seat is integrally formed from a plastic material, and the sliding damping piece is a rubber damping block.

6. The damping device for a washing machine according to claim 1, wherein an upper wall surface of the annular damping fin of the sliding damping piece contacts the upper bracket, a lower wall surface of the annular damping fin of the sliding damping piece contacts an upper end face of the sliding damping support seat, and the damping block of the sliding damping piece extends into the accommodation chamber of the sliding damping support seat.

7. The damping device for a washing machine according to claim 6, wherein the sliding damping support seat is provided with an inclined structure configured for transferring an eccentric force to generate a sliding damping acting on the damping suspension rod when the outer tub shakes or swings;

and an accommodation chamber is formed in an inner of the inclined structure.

8. The damping device for a washing machine according to claim 6, wherein an outer wall of the sliding damping support seat is provided with an annular blocking rib, and an upper end of the damping spring is abutted against the annular blocking rib.

9. The damping device for a washing machine according to claim 6, wherein the sliding damping support seat is integrally formed from a plastic material, and the sliding damping piece is a rubber damping block.

10. The damping device for a washing machine according to claim 1, wherein an annular convex rib is arranged on an upper wall surface of the annular damping fin of the sliding damping piece, and a lower wall of the upper bracket is provided with an annular groove matched with the annular convex rib.

11. The damping device for a washing machine according to claim 10, wherein the sliding damping support seat is provided with an inclined structure configured for transferring an eccentric force to generate a sliding damping acting on the damping suspension rod when the outer tub shakes or swings;

and an accommodation chamber is formed in an inner of the inclined structure.

12. The damping device for a washing machine according to claim 1, wherein the sliding damping support seat is provided with an inclined structure for transferring an eccentric force to generate a sliding damping acting on the damping suspension rod when the outer tub shakes or swings; and an accommodation chamber is formed in the inclined structure.

13. The damping device for a washing machine according to claim 12, wherein the sliding damping support seat comprises an annular body arranged at one end of the sliding damping support seat and elastomers respectively connected with the annular body, the annular body and the sliding damping piece abut each other, the elastomers extend into the damping spring, and a through hole located in the center of the sliding damping support seat allows the damping suspension rod to pass through and is formed by the elastomers;

a first part of each of the elastomers connected with the annular body is obliquely disposed to form the inclined structure, or the inclined structure is an inclined rib for connecting each of the elastomers and the annular body.

14. The damping device for a washing machine according to claim 1, wherein an outer wall of the sliding damping support seat is provided with an annular blocking rib, and an upper end of the damping spring is abutted against the annular blocking rib.

15. The damping device for a washing machine according to claim 1, wherein the sliding damping support seat is integrally formed from a plastic material, and the sliding damping piece is a rubber damping block.

16. The damping device for a washing machine according to claim 1, wherein the sliding damping support seat is provided with an inclined structure configured for transferring an eccentric force to generate a sliding damping acting on the damping suspension rod when the outer tub shakes or swings;

and an accommodation chamber is formed in an inner of the inclined structure.

17. The damping device for a washing machine according to claim 1, wherein an outer wall of the sliding damping support seat is provided with an annular blocking rib, and an upper end of the damping spring is abutted against the annular blocking rib.

18. The damping device for a washing machine according to claim 1, wherein the sliding damping support seat is integrally formed from a plastic material, and the sliding damping piece is a rubber damping block.

19. A washing machine, comprising a damping device, the damping device including a damping suspension rod;

an upper bracket;

a damping spring;

a sliding damping support seat; and a sliding damping piece, wherein an upper end of the damping suspension rod is installed on a cabinet of the washing machine, the upper bracket is installed on an outer tub of the washing machine, and the damping suspension rod passes through the upper bracket, the sliding damping piece, the sliding damping support seat and the damping spring in sequence from top to bottom, and the sliding damping piece includes an annular damping fin, multiple damping blocks arranged at one side of the annular damping fin and distributed along an inner ring of the annular damping fin, and a through hole located in a center of the annular damping fin to allow the damping suspension rod to pass through, the through hole being formed by the damping blocks, the damping spring is configured to contract, and the sliding damping piece is configured to tighten and generate a sliding damping acting on the damping suspension rod when the outer tub of the washing machine shakes or swings to apply an eccentric pressure to the upper bracket, the sliding damping support seat and the sliding damping piece are configured to simultaneously tighten to increase the sliding damping acting on the damping suspension rod when the eccentric force increases, and the damping spring is configured to extend, the sliding damping support seat and the sliding damping piece are configured to gradually loosen, gradually reducing the sliding damping acting on the damping suspension rod when the outer tub of the washing machine shakes or swings to release the upper bracket.

20. A damping device for a washing machine, the damping device comprising:

a damping suspension rod;

an upper bracket;

a damping spring;

a sliding damping support seat; and a sliding damping piece, wherein an upper end of the damping suspension rod is configured to be installed on a cabinet of the washing machine, the upper bracket is configured to be installed on an outer tub of the washing machine, and the damping suspension rod passes through the upper bracket, the sliding damping piece, the sliding damping support seat and the damping spring in sequence from top to bottom, and the sliding damping piece includes an annular damping fin, multiple damping blocks arranged at one side of the annular damping fin and distributed along an inner ring of the annular damping fin, and a through hole located in a center of the annular damping fin to allow the damping suspension rod to pass through, the through hole being formed by the damping blocks.

* * * * *